US008418394B2

(12) United States Patent
Keng

(10) Patent No.: US 8,418,394 B2
(45) Date of Patent: Apr. 16, 2013

(54) STABLE BIPOD MOUNT AND CLAMP ASSEMBLY

(75) Inventor: Da Keng, Smyrna, GA (US)

(73) Assignee: Keng's Firearms Specialty, Inc., Atlanta, GA (US)

( * ) Notice: Subject to any disclaimer, the term of this patent is extended or adjusted under 35 U.S.C. 154(b) by 500 days.

(21) Appl. No.: 12/686,628

(22) Filed: Jan. 13, 2010

(65) Prior Publication Data

US 2010/0218411 A1 Sep. 2, 2010

Related U.S. Application Data

(60) Provisional application No. 61/193,959, filed on Jan. 13, 2009.

(51) Int. Cl.
*F41A 23/10* (2006.01)

(52) U.S. Cl.
USPC ..... 42/94; 89/37.04; 248/163.2

(58) Field of Classification Search ..... 42/90, 94, 42/72; 89/37.01, 37.03, 37.04; 248/689, 248/163.2, 166, 163.1, 439; 211/64
See application file for complete search history.

(56) References Cited

U.S. PATENT DOCUMENTS

| | | | | | |
|---|---|---|---|---|---|
| 1,295,688 | A * | 2/1919 | Butler | 42/94 |
| 1,339,410 | A * | 5/1920 | Norman | 42/94 |
| 1,580,406 | A * | 4/1926 | Browning | 42/94 |
| 4,288,939 | A * | 9/1981 | Beretta | 42/94 |
| 4,345,398 | A * | 8/1982 | Pickett | 42/94 |
| 4,351,224 | A * | 9/1982 | Curtis | 89/37.04 |
| 4,359,834 | A * | 11/1982 | Beretta | 42/94 |
| 4,875,303 | A * | 10/1989 | DeWeert et al. | 42/90 |
| 5,127,647 | A * | 7/1992 | Wilkinson | 482/52 |
| 5,903,995 | A * | 5/1999 | Brubach | 42/94 |
| 7,380,486 | B1 * | 6/2008 | Bean | 89/37.04 |
| 7,500,328 | B1 * | 3/2009 | Bean | 42/94 |
| 7,614,174 | B1 * | 11/2009 | Beltz | 42/94 |
| 7,676,977 | B1 * | 3/2010 | Cahill et al. | 42/94 |
| 7,793,454 | B1 * | 9/2010 | Beltz | 42/94 |
| 2007/0068501 | A1 * | 3/2007 | Bednar | 124/25 |

* cited by examiner

*Primary Examiner* — Michael Carone
*Assistant Examiner* — Jonathan C Weber
(74) *Attorney, Agent, or Firm* — Rodgers & Rodgers

(57) ABSTRACT

A clamping assembly for releasably attaching an accessory such as a bipod to an upwardly projecting elongate support such as a picatinny-style mounting rail includes a clamping mount configured to releasably attach to the upward facing picatinny rail, so that the bipod, when deployed, suspends a device to be supported between the bipod's legs.

5 Claims, 6 Drawing Sheets

STABLE BIPOD MOUNT AND CLAMP ASSEMBLY

RELATED PATENT AND PENDING PATENT APPLICATION INFORMATION

This application claims the benefit of, and claims priority of U.S. Provisional Application No. 61/193,959, filed Jan. 13, 2009, the entire disclosure of which is hereby incorporated herein by reference. This application is owned by the applicant/owner of U.S. Pat. Nos. 5,711,103, 5,815,974, and 7,631,455, the entire disclosures of which are hereby incorporated herein by reference.

FIELD OF THE INVENTION

The present invention relates to a method of supporting firearms, to firearms accessories and support devices such as bipods, and, more particularly, to a clamp assembly for attaching an accessory to a mounting rail structure affixed to the forearm stock of a firearm. The clamp assembly is releasably attachable to the rail structure and enables quick attachment and detachment of the accessory to the firearm without modification of the rail structure or forearm stock of the firearm.

BACKGROUND OF THE INVENTION

When shooting firearms, especially in stressful tactical situations, it is important that the firearm be maintained in a steady, stable position to insure accuracy of aim. Most shooters are not able to hold a firearm consistently in a set position without wavering, especially after the onset of fatigue resulting from strain on the shooter due to the size and weight of the firearm.

Accordingly, peripheral support devices have been used in conjunction with firearms since the early creation of firearms as a means of stabilizing a firearm to reduce vibration, wavering, etc., and to improve accuracy.

In the past, shooters have used everything from large stationary objects such as rocks and tree branches to forked sticks, shooting slings, bipods and tripods. Early bipod and tripod supports typically were somewhat crude strands that generally were bulky, inconvenient and difficult to use and typically were not easily adjustable. In more recent times, bipod supports have been developed that are compact and relatively lightweight and are mountable to the forearm stock of a firearm, such as a rifle, to make the bipods portable with the firearm. Most conventional bipod supports include a pair of legs that can be pivoted from an up position adjacent the firearm stock, to a down position engaging a support surface, with the legs also being extensible to adjust the height of the support.

A problem with conventional bipods has been the inability to mount such bipods to most firearms without requiring the use of special mounting tools and/or the machining or modification of the firearm stock to accommodate the bipod. Additionally, most bipods are not designed for quick and easy attachment and release of the bipod from the firearm stock. For example, U.S. Pat. No. 5,194,678 discloses a bipod assembly that includes legs that are pivotable independently of one another for ease of adjustment, but the assembly is not easily attached or detached from the firearm. Other types of conventional bipods offer mountings that can be fitted to various types of rifles without requiring modification or machining of the rifle stock. For example, Harris Engineering, Inc. manufactures a series of bipod mounts for use with a variety of different firearms without modifying them; however, these bipod mounts do not provide for a quick release of an attached bipod support from the firearm.

One of the most popular bipods on the market has been the Parker-Hale bipod assembly, which includes a pair of telescoping legs attached to a mounting frame, and a mounting block for mounting the bipod to the firearm. The mounting block of the Parker-Hale bipod is releasably attached to the mounting frame of the bipod to enable quick attachment or release of the legs of the bipod from the firearm, but the problem with this bipod is that to mount it to a firearm, the forearm stock of the firearm generally must be modified to mount a track or slide, along which the mounting block is received to mount the bipod to the firearm. Such stock modifications generally are expensive, often must be done by specialty gunsmiths, and can mar the finish of the firearm.

Military or police shooters using military or SWAT rifles often carry special mounts known as MIL-STD-1913 "picatinny" rails under the rifle forearm; such rails are customarily used for mounting grenade launchers, lights or other accessories, so the rifles often weigh much more than the lighter sporting arms most shooters are used to carrying. Clamping objects to forearm mounted picatinny rails is usually a lengthy, cumbersome process requiring that the shooter juggle small parts in the field.

Prior art bipods which can be attached to a rifle's forearm clamping surfaces have typically attached to a rail structure that runs along the bottom of the handgrip and is parallel to the axis of the rifle's bore, to place the bipod in the traditional "below the barrel" orientation. While this below the barrel orientation is useful in many situations, it does not provide a stable support for the rifle's weight, which is above the bipod's leg-supporting hinge, so the rifle may produce a falling or leaning moment of inertia.

Accordingly, a need exists for a bipod mounting device for selectively attaching a bipod to a firearm, and in particular to a firearm adapted for use in military or SWAT situations, where the shooter may, for precision aiming, wish to have a stable support. Ideally, the attachment should not require extensive modification to the firearm, such as machining of the forearm stock of the firearm. Preferably, a mounting device would also enable quick and easy attachment and detachment of the bipod (or other accessory) to the firearm, and minimize the risks associated with a falling or leaning moment of inertia, as may occur when the rifle's barrel carries the bipod on a bottom mounted picatinny rail.

SUMMARY OF THE INVENTION

Briefly, the present invention comprises a method for releasably attaching an accessory such as a bipod assembly to an attachment point on the top of the forearm portion of a rifle, and more particularly to a clamping assembly releasably securable to an upwardly projecting elongate support such as a picatinny-style mounting rail. The bipod assembly includes a mounting clamp configured to releasably attach the bipod to the upwardly facing picatinny rail so that the bipod, when deployed, suspends the rifle between the bipod's legs and allows the rifle forearm rail to hang between the bipod legs with the force of gravity while supported from above by the clamping mount.

In a preferred form of the invention, the accessory to be mounted includes a clamping mechanism adapted for releasable attachment to an upwardly projecting elongated rail of a device to which the accessory is to be attached. In this case, the elongated rail has opposed longitudinal V shaped sides and a plurality of evenly spaced transverse notches or grooves extending between the sides of the rail. The mechanism incorporates a clamp base with a mounting lock that has a pair of opposed clamping plates adapted to engage the opposed V shaped sides of the upwardly projecting rail. The clamp base includes a substantially rectangular base plate having an upper surface and sidewalls extending downwardly therefrom. First and second elongate transverse grooves are formed across the under surface of the rectangular base plate so that the sidewalls have first and second openings or bores in which corresponding first and second laterally movable bolts are slidably disposed. The two opposed clamping plates also each include first and second openings or bores aligned with the first and second transverse grooves and are mounted on the transverse bolts on opposite sides of the base plate and secured by nuts on the ends of the bolts. To secure the clamp base to an upwardly extending mounting rail, the base plate is placed over the rail and the bolts are tightened to draw the opposed clamps into fastening engagement with the V-shaped sides of the rail. The mounting assembly also includes a yoke secured on the base plate for mounting a leg support subassembly and a pair of folding legs and a top plate for supporting a spring latch for securing the legs in a folded position. The upwardly facing mounting rail structure on the forearm is often affixed on four sides (above, below left and right) of the forearm stock (e.g., as for an M4, CAR-15, SAW or other military long gun). In an illustrative embodiment, the present invention is directed to use for mounting a Parker-Hale style of firearm bipod of the type including a mounting block with an integral clamp assembly to attach to the rifle's forearm at a point on the upper surface of the forearm stock.

In accordance with the method of the present invention, a bipod or similar assembly may be mounted on an upwardly facing support rail having V shaped sides by providing a mounting clamp with a mounting lock that is adapted to slide over and receive the opposing V shaped sides. The method includes providing a substantially rectangular base plate having an upper surface and including downwardly extending sidewalls, forming first and second elongate transverse grooves across the under surface of the base plate, including first and second openings or bores in the sidewalls aligned with the first and second transverse grooves, providing first and second opposed rail clamping plates on opposite sides of the base plate with bores aligned with the sidewall bores. The mounting clamp is secured to a rail by sliding the base plate over the upwardly projecting rail to a selected position then inserting transverse bolts through the opposed rail clamping plates on opposite sides of the base plate and through the first and second elongate transverse grooves in the rectangular base plate, and tightening the bolts to secure the base plate. In the preferred form of the invention described herein, the method further includes mounting movable, extendable left and right bipod legs to the base plate and deploying said first and second bipod legs between a retracted, or horizontal, non-supportive, carry position and a supporting, or vertical supportive position, with the bipod legs optionally being extended in a manner which allows a firearm forearm rail to hang between the bipod legs with the force of gravity while supported from above by the mount's base plate. When retracted, the attached bipod assembly or other support or accessory is placed in locking engagement with the firearm.

BRIEF DESCRIPTION OF THE DRAWINGS

Various objects, features and advantages of the present invention will become apparent to one skilled in the art upon a review of the following specification, when taken in conjunction with the accompanying drawings, in which.

DETAILED DESCRIPTION OF A PREFERRED EMBODIMENT

Figure 1:
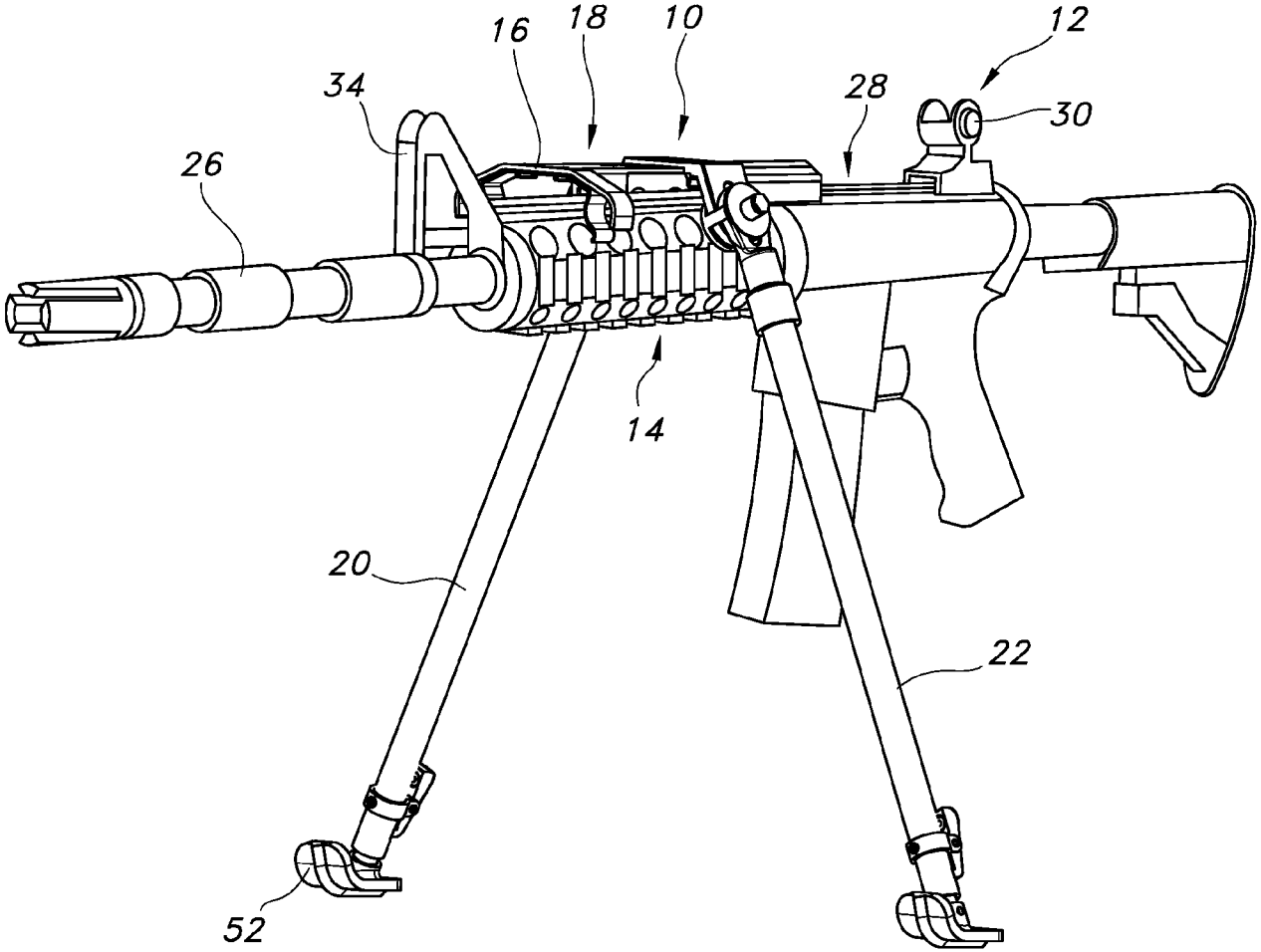
FIG. 1 is a side perspective view of a firearm supported by a bipod assembly secured to the forearm stock of the firearm in accordance with a preferred embodiment of the present invention.

Turning now to a more detailed description of the present invention, reference is made to FIGS. 1-8, in which common numerals indicate similar parts throughout the several views. A bipod assembly 10 is illustrated as being secured to a conventional firearm or rifle 12 having a forearm portion 14 that incorporates an upwardly projecting elongate weaver style or picatinny arsenal style elongate mounting rail 16, which is typically affixed on four sides (left, right, top and bottom) of a rifle's forearm stock. The bipod assembly of the present invention incorporates a clamp assembly 18 for mounting the bipod or other accessory to the firearm mounting rail. Although the invention is here described in terms of a bipod that is clamped, or secured, to a rifle forearm rail, it will be understood that the clamping assembly may be used to clamp equipment other than a bipod to a firearm, or may be used to clamp equipment to another device or instrument having an upwardly extending fastening rail or equivalent structure.

The bipod assembly 10 is mounted to the forearm stock 14 of the firearm 12 by clamping it, to the top of the upwardly projecting elongate mounting rail 16 so that the firearm 12, or other device to be supported, can hang below the clamp assembly 18 and extend between support legs 20 and 22 of the bipod assembly, as illustrated in FIG. 1.

Figure 2:
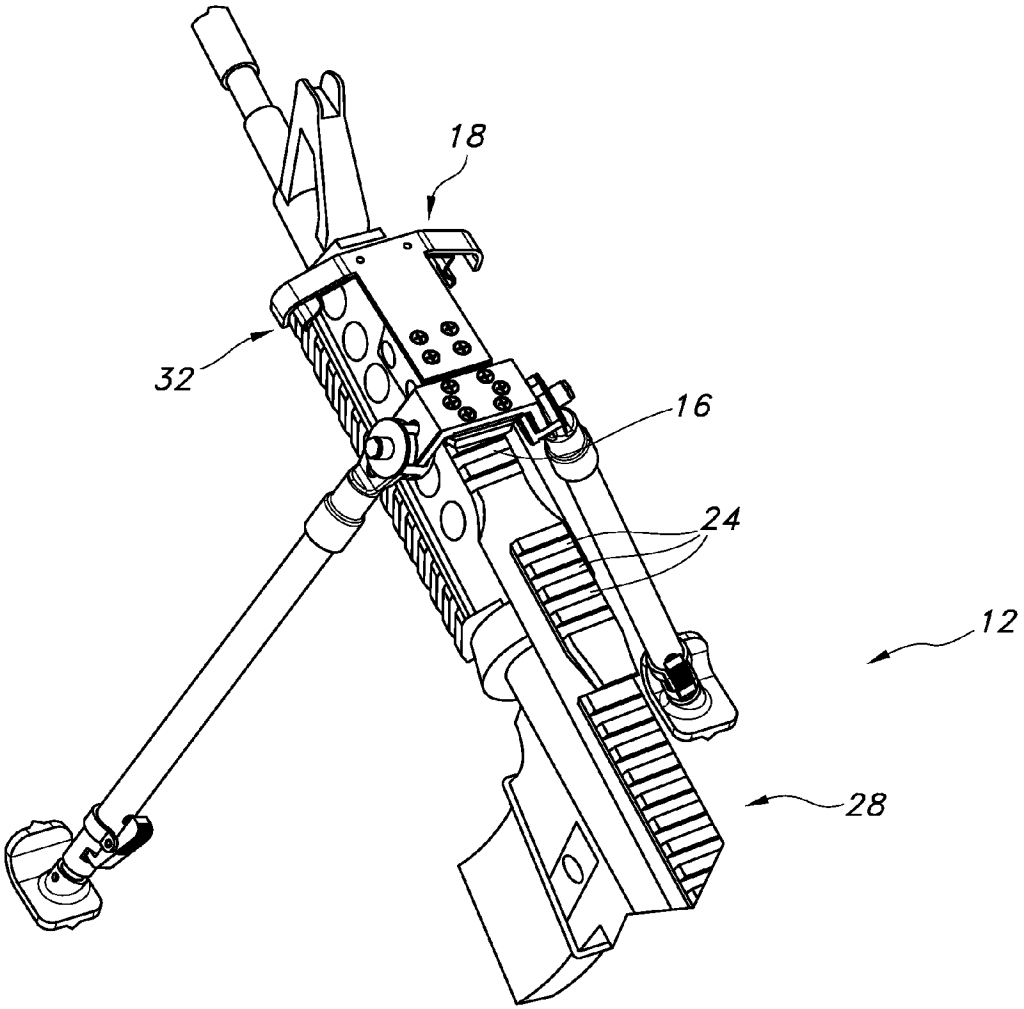
FIG. 2 is a top perspective view of the firearm and mounted bipod assembly of FIG. 1.

The top mounting rail 16 on forearm 12 can be any suitably strong and rigid elongate supporting structure; in the above described illustrative embodiment, it is a picatinny rail mounting structure (i.e., a MIL-STD-1913 picatinny rail) having a plurality of evenly spaced standard size transverse grooves 24, best illustrated in FIG. 2, and longitudinal V-shaped opposed sides. The mounting rail is preferably aligned with, and parallel with the operational axis of the device or instrument to which an assembly such as the bipod assembly illustrated in the Figures is to be secured. In the illustrated embodiment, the rail 16 is aligned with the central axis of the barrel 26 of firearm 12, and terminates at a proximal end near the rear sight 30 and at a distal end 32, near the front sight 34.

Figures 3, 4:
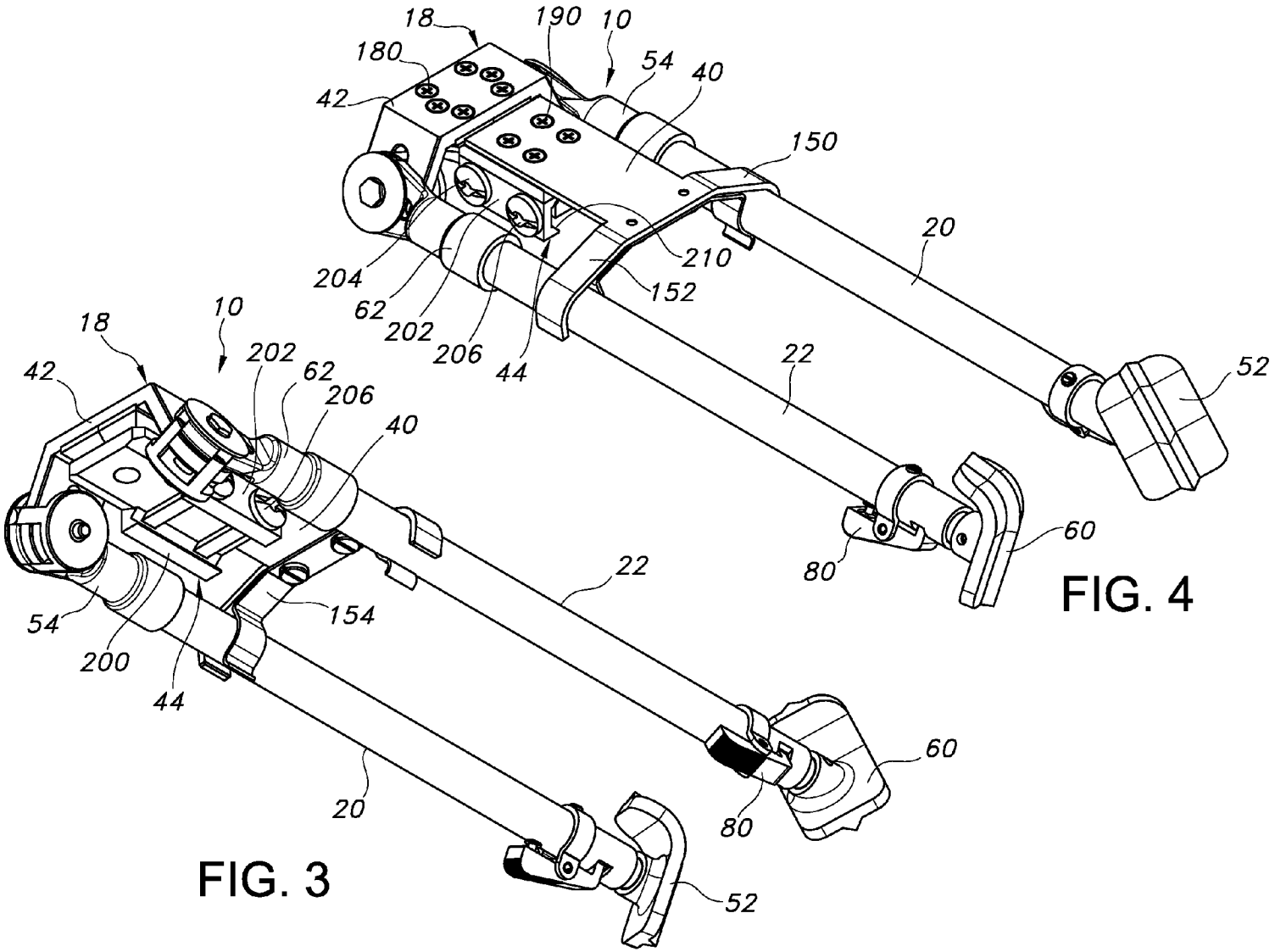
FIG. 3 is a bottom perspective view of the bipod assembly of the present invention, illustrating the bipod legs in the retracted position.
FIG. 4 is a top perspective view of the assembly of FIG. 3.

As generally illustrated in FIGS. 3 and 4, the bipod assembly 10 includes the clamping assembly 18, which incorporates an elongated top plate 40 secured to a transverse yoke 42 by way of a central clamping rail mount 44 secured to the underside of the top plate. The right support leg 20 is secured to arm 48 by a leg subassembly 50, as illustrated in FIG. 3 and in the exploded view of FIGS. 5 and 6. The support leg carries at its distal, or bottom end a right ridged foot 52, and at its near, or top end a leg coupler, or top, 54 which engages a spindle pin 56 which is a part of the subassembly 50 to enable the leg 20 to pivot with respect to the clamp assembly 18. Left support leg 22 is similar to support leg 20, and thus includes a left foot 60 at its bottom end and a coupler 62 at its top end, with couple 62 engaging a spindle pin 64 which is a part of a leg subassembly 66 secured to a leg 68 of the yoke 42 to enable pivotal motion of leg 22 with respect to the clamp assembly 18.

Figure 5:
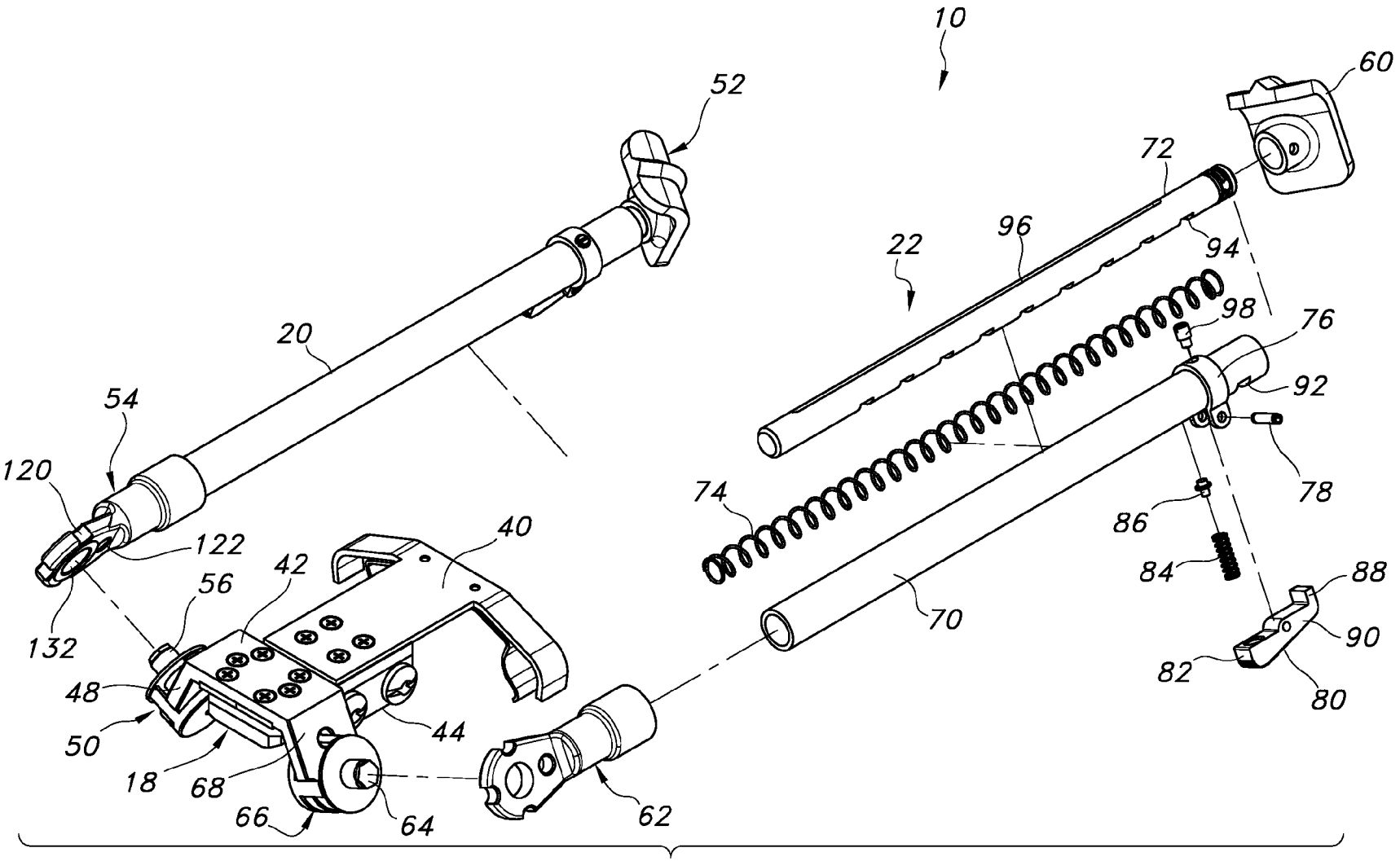
FIG. 5 is an exploded view of the bipod assembly of FIGS. 3 and 4.

The support legs 20 and 22 may take many forms, but in a suitable configuration, illustrated in FIG. 5 for leg 22, each may incorporate an outer leg tube 70 which may, for example, be about ten inches in length, an inner tubular leg extension 72 which telescopes into the open lumen of tube 70, and a leg spring 74 located within the tube 70 to urge the inner and outer tubes apart to extend the leg. The upper end of tube 70 engages the coupler 62, while the lower end of inner tube is pivotally secured to foot 60. To secure the telescoped tubes at the desired extension, a catch bracket 76 is secured around the leg tube 70 by a pin 78, on which a catch 80 is pivotally mounted. The catch is spring-loaded at a first end 82 by a catch spring 84, which is held in place by a peg 86, to urge a tooth 88 at the opposite end 90 of the catch into a slot 92 in the outer tube. The tooth passes through the slot 92 to engage a selected one of a plurality of transverse grooves or slots 94 in the side wall of the inner tube 72 to allow adjustment of the length of the leg 22. The catch 80 may be pivoted against the spring to allow the leg to be retracted or extended. A longitudinal groove 96 extends along the inner tube 72 and is engaged by a spline screw 98 threaded into the outer tube to prevent rotation of the inner tube with respect to the outer tube of the leg 22.

Figure 6:
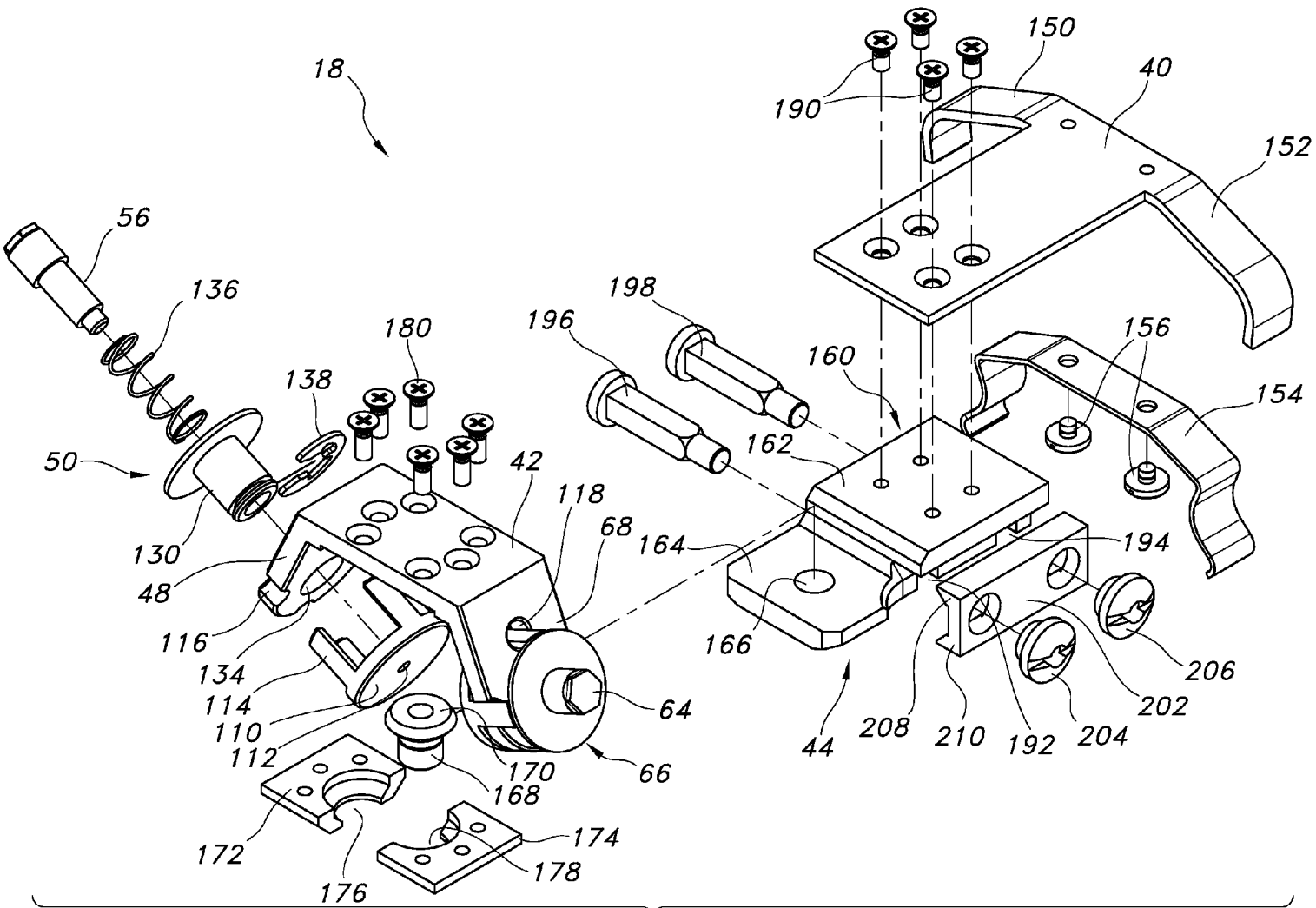
FIG. 6 is an exploded view of the clamping assembly portion of the bipod assembly of FIG. 5.

The leg subassembly 50, illustrated in an exploded view in FIG. 6, includes a cup portion 110 which engages the inner surface of corresponding yoke 48 and incorporates a central aperture 112. The cup has four legs 114 which extend past the yoke 48 through grooves 116 on the edge of the yoke or through an aperture 118 as illustrated on yoke 68, to engage corresponding grooves 120 or aperture 122 on the leg coupler 54 (see FIG. 5) to serve as a releasable leg stop to prevent rotation of the cup and of the leg with respect to the yoke. A flanged bushing 130 extends through a central aperture 132 in the leg coupler 54 and then through an aperture 134 in yoke arm 48 to allow the bushing to move axially through the aperture 134 and to engage the interior of the cup 110. The bushing pivotally mounts the leg 20 to the yoke arm 48. Spindle pin 56 passes through a compression spring 136 and through the bushing and is secured in place by an E-ring 138 inside the yoke arm, with a shoulder 140 on the pin engaging the flange. Depression of the spindle pin 56 compresses spring 136 and allows the pin to push locking cup 110 inwardly to disengage the legs 114 from the grooves 120 on the leg coupler 54 to allow the support leg 20 to be pivoted between retracted and extended positions. FIGS. 5 and 6 illustrate that left leg subassembly 66 is similarly constructed to pivotally secure support left leg 22 to left yoke arm 68.

The rearward end of top plate 40 includes a pair of transverse arms 150 and 152 which are curved downwardly at their outer ends to receive and releasably retain the legs 20 and 22, respectively, in their retracted position. A curved spring 154 is secured to the undersurface of the plate 40, as by screws 156 below the transverse arms 150 and 152 to form a spring clamp for securing the legs against the arms, as illustrated in FIGS. 3 and 4.

As noted above, the top plate 40 is secured to the yoke 42 by the clamping rail mount assembly 44, as illustrated in FIGS. 3-6. The rail mount 44 includes a clamp base 160 which consists of a base plate having a generally rectangular rear portion 162 and a forwardly-extending tongue portion 164, with the top surface of the tongue portion being stepped down from the top surface of the rear portion, as illustrated. A threaded aperture 166 in the tongue portion 164 receives a threaded pivot pin 168 which is positioned below the yoke 42 and extends up toward the bottom surface of the yoke. The head 170 of pin 168 is captured between a pair of plates 172 and 174, which have corresponding concave grooves 176 and 178 to receive the head 170. The plates are fastened to the under surface of the yoke 42 by screws 180 so that the head 170 is rotatably secured between the plates to thereby pivotally secure the clamp base 160, and thus the top plate 40, to the yoke 42.

As best illustrated in FIGS. 3 and 6, clamp base plate 160 is fastened to the bottom surface of top plate 40 by screws 190. The under surface of the base plate is grooved transversely at 192 and 194 to receive transverse bolts 196 and 198, respectively, which pass through corresponding apertures in first and second rail clamping plates 200 and 202 and are secured by corresponding nuts 204 and 206. Each of the clamping plates includes an upper and a lower inwardly-facing longitudinal ridge, illustrated at 208 and 210, respectively, for the plate 202, the upper ridges being located to engage the lateral edges of base plate 162, beneath the top plate 40, and the lower ridges being located below the base plate and extending inwardly to engage a mounting rail on a device such as the firearm 12. With the nuts loosened, the rail clamping rails can be placed on the firearm mounting rail, and by tightening the nuts 204 and 206, the clamp assembly 18 is secured to the firearm.

When the bipod assembly 10 is needed, therefore, it can quickly, and releasably, be secured to an attachment point which may be an upwardly projecting elongate support such as a picatinny-style mounting rail on the top of the forearm portion of a rifle. The bipod assembly rail clamping mount 18 is configured to be releasably attached to the upward facing picatinny rail so that the bipod assembly, when deployed, suspends the rifle between the bipod legs to allow the rifle forearm rail to hang between the bipod legs with the force of gravity being advantageously employed to suspend and support the rifle in a substantially vertical, ready-to-aim orientation.

Figure 8:
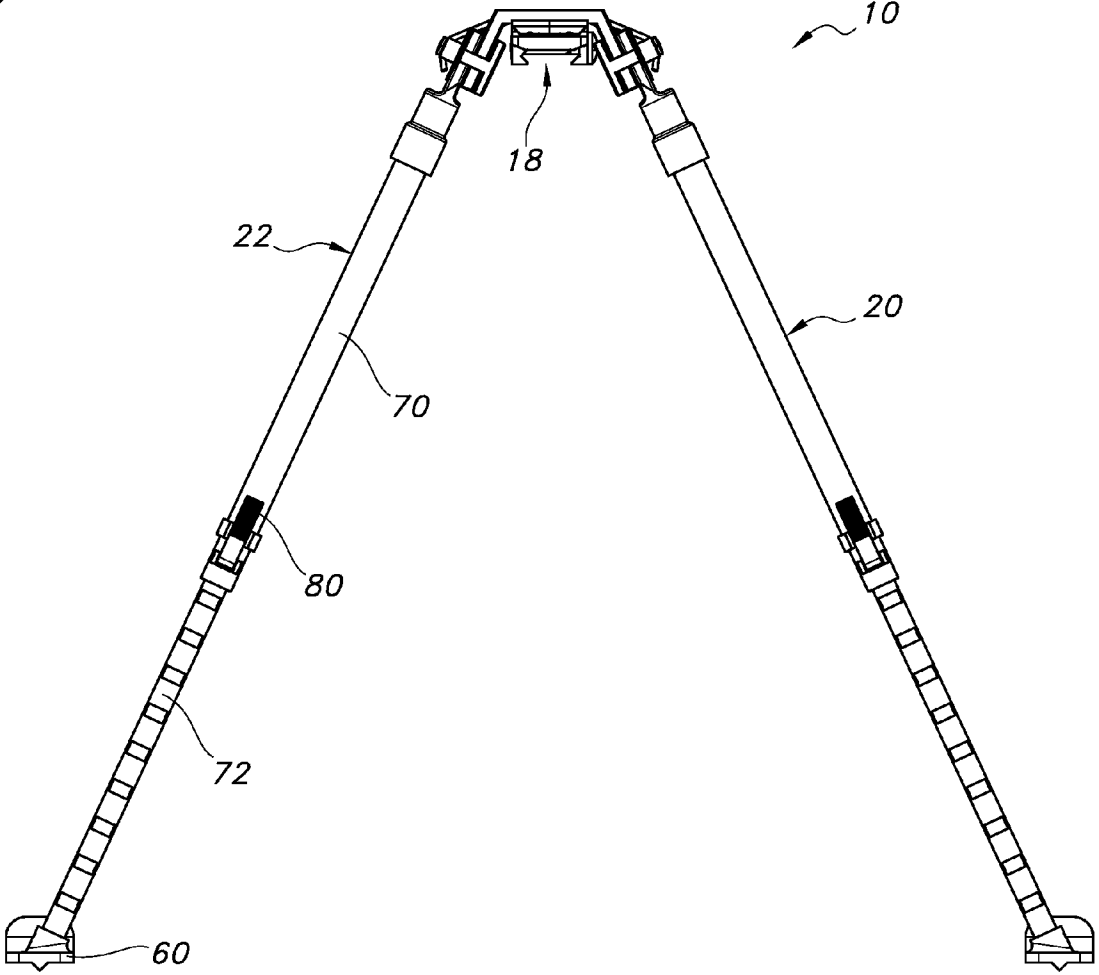
FIG. 8 is an end plan view of the bipod assembly of FIG. 7.
Figure 7:
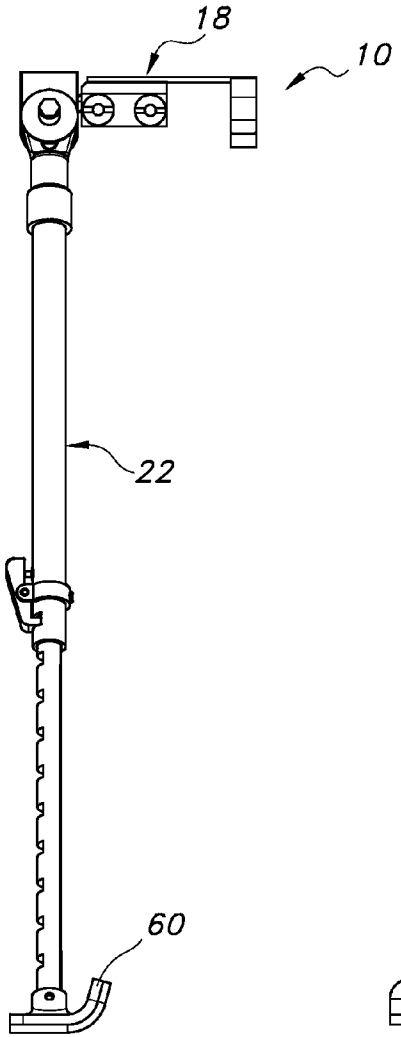
FIG. 7 is a side plan view of the bipod assembly of the present invention, illustrating the bipod legs in an extended position.

Once it is attached to the firearm, the bipod's legs can be retracted and can be swiveled to a horizontal, or non-supportive, carry position, as illustrated in FIGS. 3 and 4, or deployed into a downwardly projecting supporting position (as in FIGS. 1-3), with the bipod legs optionally extended, as illustrated in FIGS. 7 and 8, whereupon the bipod's leg's distal ends can be lowered onto and engage the ground or another supportive surface.

In accordance with the present invention, the method is for supporting or suspending firearm 12 (or another portable instrument) with clamp assembly 12 which is releasably attachable to upwardly facing support rail 16 (having left and right V-shaped sides and terminating in a proximal first end opposite a distal second end 32) and the method includes the following steps:

providing a clamping assembly 18 with a clamp base having a mounting lock that is adapted to slide over one end of, and to receive the opposing V shaped sides of the upwardly facing support rail 16;

providing, in the clamp base, a substantially rectangular base plate including a downwardly extending sidewall;

providing a top plate 40 on the base plate carrying a movable, extendable left bipod leg 22 and a movable, extendable right bipod leg 20;

forming on the undersurface of the base plate first and second elongate transverse grooves extending through said sidewall on opposed sides of said clamp base to form first and second openings aligned with the transverse grooves;

providing a pair of transverse arms 150 and 152 which are curved downwardly at their outer ends to receive and releasably retain the legs 20 and 22, respectively, in their retracted position.

positioning first and second rail clamping plates on opposite sides of the base plate and aligning corresponding apertures in the rail clamping plates with the openings;

inserting first and second transversly movable bolts 196, 198 through the apertures in the first rail clamping plate, through the corresponding transverse grooves and through apertures in the second rail clamping plate to form a mount lock;

attaching the base and the mount lock to the upwardly projecting rail 16 by sliding the base over one of the upwardly projecting rail's ends and along the axis of the rail 16 to a selected position and securing bolts 196, 198; and releasing the legs 20 and 22, respectively, when in their retracted position, from the spring clamp of transverse arms 150 and 152 and deploying said first and second bipod legs in a downwardly projecting manner which allows the support rail to hang vertically between the bipod's legs.

It will be understood that while the foregoing relates to a preferred embodiment of the present invention, various modifications, additions and changes may be made thereto without departing from the spirit and scope of the invention as set forth in the claims. Further, it will be understood by those skilled in the art that while the present invention has been disclosed for use primarily with a Parker-Hale bipod assembly, the present invention also can be used for mounting the types of bipods having a bipod leg frame that is releasably mountable to a mounting block for a firearm.

What is claimed is:

1. An accessory mount adapted for releasable attachment to an upwardly projecting elongated rail having opposed longitudinal V-shaped sides and a plurality of evenly spaced transverse notches or grooves, comprising:

a clamp base having a mounting lock to engage opposed V-shaped sides of an upwardly projecting rail;

said clamp base including a substantially rectangular base plate surface having an upper surface and including sidewalls extending downwardly therefrom;

first and second elongate transverse grooves formed across an underside of said rectangular base plate, said transverse grooves extending through said sidewall on opposite sides of said base plate to form corresponding first and second openings aligned with said grooves;

a mounting lock including first and second rail clamping plates each having first and second openings aligned with said first and second transverse grooves;

first and second laterally movable bolts extending through corresponding apertures in said clamping plates and slidably disposed within said first and second elongate transverse grooves;

first and second fasteners on said bolts for securing said rail clamping plates against opposed side walls of said base plate and against the V-shaped sides of an upwardly projecting rail, whereby said first and second transverse bolts are tightenable to secure the accessory mount to a rail;

a top plate secured to said clamp base and carrying a yoke;

said yoke having first and second spaced arm portions carrying respective first and second leg subassemblies incorporating corresponding first and second movable and extendable support legs;

a latching spring carried by said top plate;

said latching spring comprising an assembly including first and second pairs of transverse arms which are curved downwardly at their outer ends to receive and releasably retain said first and second leg subassemblies in their retracted position;

said first pair of transverse arms defined by a curved spring member secured to the undersurface of said top plate; and said second pair of transverse arms defined by transversely projecting curved members projecting laterally from said top plate.

2. The accessory mount of claim 1, further including a pivot pin mounted on said base plate to pivotally mount said yoke on said clamp base plate.

3. The accessory mount of claim 2, wherein said at least one support leg subassembly includes a leg lock mounted on an arm portion of said yoke and a bushing slidable in an aperture in said arm portion to release said leg lock to allow the corresponding support leg to pivot with respect to its yoke arm.

4. A method for suspending a firearm or other instrument by a clamp assembly releasably attachable to an upwardly facing support rail having V-shaped sides and first and second ends, said clamp assembly comprising:

a clamp base having a mounting lock to engage opposed V-shaped sides of said upwardly facing support rail;

said clamp base including a substantially rectangular base plate surface having an upper surface and including sidewalls extending downwardly therefrom;

first and second elongate transverse grooves formed across an underside of said rectangular base plate, said transverse grooves extending through said sidewall on opposite sides of said base plate to form corresponding first and second openings aligned with said grooves;

a mounting lock including first and second rail clamping plates each having first and second openings aligned with said first and second transverse grooves;

first and second laterally movable bolts extending through corresponding apertures in said clamping plates and slidably disposed within said first and second elongate transverse grooves;

first and second fasteners on said bolts for securing said rail clamping plates against opposed side walls of said base plate and against the V-shaped sides of an upwardly projecting rail, whereby said first and second transverse bolts are tightenahie to secure the accessory mount to a rail;

a top plate secured to said clamp base and carrying a yoke;

said yoke having first and second spaced arm portions carrying respective first and second leg subassemblies incorporating corresponding first and second movable and extendable support legs;

a latching spring carried by said top plate;

said latching spring comprising an assembly including first and second pairs of transverse arms which are curved downwardly at their outer ends to receive and releasably retain said first and second leg subassemblies in their retracted position;

said first pair of transverse arms defined by a curved spring member secured to the undersurface of said top plate; and said second pair of transverse arms defined by transversely projecting curved members projecting laterally from said top plate the method comprising the steps of:

(a) providing a clamp base with a mounting lock that is adapted to slide over one end of, and to receive the opposing V-shaped sides of the upwardly facing support rail;

(b) providing, in said clamp base, a substantially rectangular base plate including a downwardly extending sidewall;

(c) providing a top plate on said base plate carrying movable, extendable left and right bipod legs;

(d) forming on the undersurface of said base plate first and second elongate transverse grooves extending through said sidewall on opposed sides of said clamp base to form first and second openings aligned with said transverse grooves;

(e) positioning first and second rail clamping plates on opposite sides of said base plate and aligning corresponding apertures in the rail clamping plates with said openings;

(f) inserting first and second transversely movable bolts through apertures in said first rail clamping plate, through said corresponding transverse grooves and through apertures in said second rail clamping plate to form a mount lock; and (g) attaching said base and said mount lock to said upwardly projecting rail by sliding said base over said upwardly projecting rail end and along the axis of the rail to a selected position and securing said bolts.

5. The method of claim 4, further comprising:

(h) deploying said first and second bipod legs in a downwardly projecting manner which allows the support rail to hang between the bipod.

* * * * *